United States Patent [19]

Cone et al.

[11] 4,179,125

[45] Dec. 18, 1979

[54] LEVEL-INDICATING PUTTER

[75] Inventors: Bryan N. Cone, Carpinteria; Michael F. Aboussouan, Lake View Terrace, both of Calif.

[73] Assignee: Michael F. Aboussouan, Lake View Terrace, Calif.

[21] Appl. No.: 887,704

[22] Filed: Mar. 17, 1978

[51] Int. Cl.[2] ..... A63B 53/00

[52] U.S. Cl. ..... 273/162 B

[58] Field of Search ..... 273/32 H, 162 R, 162 B, 273/183 D, 186 A, 193 R, 194 R; 33/334, 377, 384

[56] References Cited

U.S. PATENT DOCUMENTS

| | | | |
|---|---|---|---|
| 2,919,491 | 1/1960 | Darrell et al. | 273/162 B X |
| 2,968,098 | 1/1961 | Collin | 33/384 X |
| 3,318,602 | 5/1967 | Kunihisa | 273/194 R X |

FOREIGN PATENT DOCUMENTS

| | | | |
|---|---|---|---|
| 483547 | 8/1953 | Italy | 33/384 |

*Primary Examiner*—Richard J. Apley

*Attorney, Agent, or Firm*—Jessup & Beecher

[57] ABSTRACT

A level-indicating device and the method of placing said device inside the shaft of a golf putter. The device is so placed within the shaft so that when the putter is laid horizontal on the surface of the green the device will indicate the exact slope of the green at that point. The device is an insert so constructed as to be inserted into the putter shaft from the top of the shaft (grip end) before the grip is placed on the shaft. It is molded to an exact fit inside the shaft and as the shaft is tapered, it will be properly placed when the top end of the insert is flush with the grip end of the shaft. The lower end of the insert has a cavity just large enough to accommodate a levelling vial. The vial cavity is cast so that when the vial is snapped into the device it will be exactly in the desired position and will be completely protected by the insert. The length of the insert is such that the center of the vial will be centered in a window slot that has been precut in the shaft so that the vial can be viewed. The window slot is located just below the bottom of the grip when the grip is placed in position on the shaft.

5 Claims, 4 Drawing Figures

2
2
14
3
18
3
10
12
16

14
26
20
18
22
24
32
34
10

14
28
22
10
38
18
36
20
22

LEVEL-INDICATING PUTTER

BACKGROUND OF THE INVENTION

This invention relates to golf clubs generally and to putters in particular, with a novel device for indicating the slope and pitch of a putting green.

It is difficult, when on a putting green, to accurately determine the slope and pitch simply by visual examination. For that reason devices have been invented for incorporation into putters for giving some indication of the slope and pitch of the green to aid in determining with accuracy just what direction a putt must be stroked. One such device is disclosed in the U.S. Pat. No. of Darrel et al., 2,919,491, issued on Jan. 5, 1960. In the Darrel device a levelling vial is fitted into the shaft of the putter between the grip and the putter head. The levelling vial is installed by cutting a slot in the shaft and inserting the vial directly into the cut slot and then setting and gluing the vial in a level position.

While this method of installation is not entirely unsatisfactory, it suffers from some disadvantages. One of the disadvantages is getting the levelling vial properly installed and adjusted to compensate for the offset between the grip of the putter shaft and the putter head. Another problem is the lack of protection of the levelling vial from the flexing of the shaft as well as damage from being struck. Incidental to these problems is the problem of the weakening of the shaft by cutting a large enough slot into the shaft to accommodate the levelling vial. The purpose of the present invention is to eliminate all the disadvantages and to protect the vial from damage, to improve the appearance of the product and to get positive settings under a mass production condition.

SUMMARY OF THE INVENTION

The purpose of the present invention is to provide a level-indicating putter which can be a mass-produced marketable product.

The present invention is an improvement on the Darrell et al. U.S. Pat. No. 2,919,491, in that the levelling vial or bulb is properly positioned in the shaft and is protected by surrounding enclosure, formed by an insert inside the shaft. The insert is formed to fit the contour of the shaft which generally tapers outward from the club head to the grip. The length of the insert is such that when the insert is installed in the shaft, it automatically positions and centers the levelling vial to a precut slot in the shaft. In addition to properly positioning the levelling vial to level position, the insert also provides the function of stiffening the shaft to prevent any damage to the device from excess flex.

The insert is an elongate plastic tapered member having a semi-circular elongate receptacle into which the levelling vial may be securely snapped. The bottom surface of the receptacle is slightly angled to compensate for club head offset between the grip and the club head when the insert is installed in the shaft. Since there are many different types of club heads, a preformed mold having a removable plug permits adjusting the level position. The plastic insert with the receptacle provides complete protection for the vial. However, should the vial be damaged by careless or rough treatment, it can easily be replaced by removal of the device from the shaft.

It is one object of the present invention to provide a novel level-indicating putter that will have a simplified method of installing the levelling device in the club shaft.

Another object of the present invention is to provide a level-indicating putter with an insert that will support the vial and not weaken the club shaft.

Another object of the present invention is to provide a level-indicating putter wherein the insert for supporting the vial incorporates means for compensating for the offset between the club head and the grip in order to maintain the vial in level position.

Still another object of the present invention is to provide a level-indicating putter having a stiff insert which serves to strengthen the club shaft.

Other objects, advantages and novel features of the invention will become apparent from the following detailed description of the invention when considered in conjunction with the accompanying drawings wherein like reference numbers identify like parts throughout.

DETAILED DESCRIPTION OF THE PREFERRED EMBODIMENT

Figures 1, 2, 3, 4:
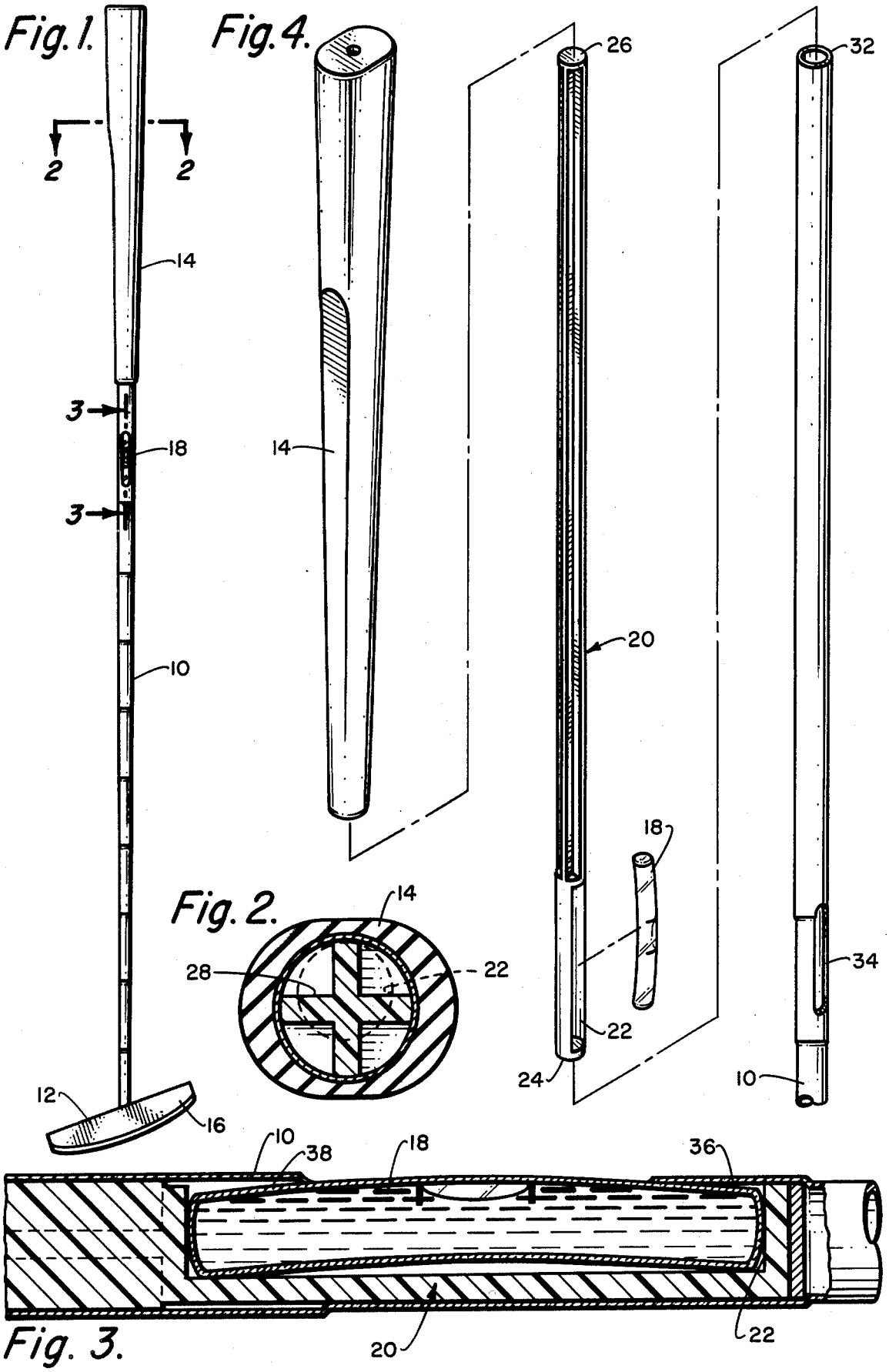
FIG. 1 is a side elevation of a putter according to the invention.
FIG. 2 is a sectional view of the putter of FIG. 1 taken at 2—2.
FIG. 3 is a partial sectional view of the invention taken at 3—3 of FIG. 1.
FIG. 4 is an exploded view illustrating the assembly of the invention.

As in the patent referred to above, this invention consists of a putter having an elongate tapering shaft 10 which has a putter head 12 at one end and a handle or grip 14 at the opposite end. The putter head 12 can be of a variety of designs from what is referred to as a blade putter to one called a mallet head putter. These types of putters differ in that in the former the putter head is relatively thin, while in the latter the putter head is thick and heavy. Each produces a different offset of the striking face 16 of the putter head 12. For this reason proper positioning of a levelling vial 18 in the shaft 10 of the putter is important. Further, without proper support, the levelling vial when installed in the shaft could be easily damaged.

In order to properly position the levelling vial 18 (FIG. 4) and simultaneously provide the proper protection, an insert 20 is provided. The insert 20 is provided with a tubular receptacle or cavity 22 at one end contoured to substantially surround the levelling vial 18. The insert is constructed of a plastic material having sufficient flexibility to permit snapping the levelling vial 18 into the tubular receptacle 12. A suitable plastic for this is known as ABS, (arylonitrile-butadiene-styrene). This plastic is preferred because it can easily be molded to form the insert 20, although a number of other plastic compositions or other materials would be suitable.

Because the shaft 18 usually tapers outward from the end nearest the club head 12 toward the end nearest the grip 14, the insert 20 would also be tapered to fit the contour of the shaft. Thus, the insert 20 would be tapered outward from end 24 to end 26. The insert 20 is formed with ribs 28 shown more clearly in FIG. 2 to economize on material and provide additional stiffness from the end of the tubular receptacle 22. Another reason for tapering the insert 20 is so it will fit snugly inside the contour of the shaft. Thus, when the levelling vial 18 is snapped into the slot or receptacle 22 and the insert 20 inserted in the shaft with the end 26 flush with the end 32 of the shaft, the levelling vial 18 automatically is positioned adjacent to the slot or window 34 precut in the shaft. The tapering of the insert 20 along with selection of the proper length automatically positions the levelling vial adjacent to the slot 34.

The insert 20 not only properly positions the levelling vial 18 automatically, but also provides two additional functions. Because the slot 34 in the shaft causes some weakening of the shaft, the stiff insert 20 strengthens the overall shaft.

This is illustrated in FIG. 3. As can be seen from this figure, the tubular receptacle 22 is tapered from right to left so that the levelling vial is slightly higher at end 36 than at end 38, as can be seen by the separation of the levelling vial from the interior of the shaft 10. In other words, in most cases the cavity 22 will have a slope such that end 36 of the vial 18 will be slightly higher than end 38. The slope is in this direction because usually club head 12 is larger in the rear than the grip 14, causing an offset from the club head downward toward the grip 14. With a putter having a blade-type club head, no or zero compensation may be needed, while in some other cases where the club head extends forward of the shaft the vial 18 may need to be on the other side of the shaft 10.

Thus, there has been described a novel level-indicating putter having an insert for properly positioning and placing the levelling indicator in the club shaft. This insert provides easy installation and assembly, while at the same time strengthens the club shaft and prtects the levelling vial.

Obviously, many modifications and variations of the present invention are possible in light of the above teachings. It is therefore to be understood that the full scope of the invention is not limited to the details disclosed herein and may be practiced otherwise than as specifically described.

What is claimed is:

1. A level-indicating putter comprising:
a shaft;
an offset head at one end of said shaft;
a grip at the other end of said shaft;
an insert mounted within and extending a substantial distance along the length of said shaft;
a receptacle preformed in and located near one end of said insert;
a levelling vial placed in said receptacle and exposed to view through a slot cut in the shaft; and
said insert so positioning said level within said shaft with respect to said offset head and grip that the vial is supported in a level position when the head and grip rest upon a level plane.

2. The level-indicating putter according to claim 1 wherein the length of said insert is chosen so that the levelling vial is automatically positioned properly in the shaft when the end of the insert is substantially flush with the end of the shaft.

3. The level-indicating putter according to claim 1 wherein the receptacle in the insert has a predetermined shape to compensate for offset between the grip and head in order to define a level plane.

4. The level-indicating putter according to claim 1 wherein said insert is molded from a plastic material.

5. The level-indicating putter according to claim 1 wherein the insert is constructed to conform to the inside diameter of the shaft whereby the insert acts to strengthen the shaft.

* * * * *